US010904691B2

(12) United States Patent
Tu et al.

(10) Patent No.: US 10,904,691 B2
(45) Date of Patent: *Jan. 26, 2021

(54) SPEAKER ADJUSTMENT METHOD AND ELECTRONIC DEVICE USING THE SAME

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/681,823

(22) Filed: Nov. 13, 2019

(65) Prior Publication Data

US 2020/0359153 A1 Nov. 12, 2020

(30) Foreign Application Priority Data

May 7, 2019 (TW) ..... 108115706 A

(51) Int. Cl.

| | |
|---|---|
| ***H04S 7/00*** | (2006.01) |
| ***H04R 5/02*** | (2006.01) |
| ***H04R 5/04*** | (2006.01) |
| ***H04R 3/12*** | (2006.01) |
| ***H04S 1/00*** | (2006.01) |

(52) U.S. Cl.

CPC ..... *H04S 7/301* (2013.01); *H04R 3/12* (2013.01); *H04R 5/02* (2013.01); *H04R 5/04* (2013.01); *H04S 1/007* (2013.01); *H04S 2400/13* (2013.01); *H04S 2400/15* (2013.01)

(58) Field of Classification Search

CPC ..... H04S 7/301; H04S 1/007; H04S 2400/13; H04S 2400/15; H04R 3/12; H04R 5/02; H04R 5/04

USPC ..... 381/92, 59, 303, 58, 103, 26, 56, 94.2, 381/98, 122, 91, 101, 322, 332, 334, 381/71.11, 80

See application file for complete search history.

(56) References Cited

U.S. PATENT DOCUMENTS 5,450,494 A * 9/1995 Okubo ..... H03G 3/32 348/E5.122

6,195,435 B1 2/2001 Kitamura (Continued)

FOREIGN PATENT DOCUMENTS

| | | |
|---|---|---|
| CN | 108600489 | 9/2018 |
| TW | 200623937 | 7/2006 |

(Continued)

OTHER PUBLICATIONS

"Search Report of Europe Counterpart Application", dated Jun. 15, 2020, p. 1-p. 7.

*Primary Examiner* — Norman Yu

(74) *Attorney, Agent, or Firm* — JCIPRNET

(57) ABSTRACT

A speaker adjustment method for adjusting a plurality of speakers is provided. The speaker adjustment method includes the following steps: respectively obtaining a plurality of frequency responses of the plurality of speakers by using one microphone; obtaining distance information between the microphone and the plurality of speakers; and adjusting outputs of the plurality of speakers according to the plurality of frequency responses and the distance information. In addition, an electronic device using the speaker adjustment method is also provided.

18 Claims, 2 Drawing Sheets

(56) References Cited

U.S. PATENT DOCUMENTS

| | | | | |
|---|---|---|---|---|
| 2015/0078596 | A1* | 3/2015 | Sprogis | H04S 7/301<br>381/303 |
| 2016/0021481 | A1* | 1/2016 | Johnson | H04S 7/303<br>381/303 |
| 2017/0215017 | A1* | 7/2017 | Hartung | H04S 7/301 |
| 2019/0253798 | A1* | 8/2019 | Sekiguchi | H04R 3/12 |

FOREIGN PATENT DOCUMENTS

| | | |
|---|---|---|
| TW | M387444 | 8/2010 |
| WO | 2013058728 | 4/2013 |

* cited by examiner

SPEAKER ADJUSTMENT METHOD AND ELECTRONIC DEVICE USING THE SAME

CROSS-REFERENCE TO RELATED APPLICATION

This application claims the priority benefit of Taiwan application serial no. 108115706, filed on May 7, 2019. The entirety of the above-mentioned patent application is hereby incorporated by reference herein and made a part of this specification.

BACKGROUND OF THE DISCLOSURE

Field of the Disclosure

The present disclosure relates to a speaker adjusting technique, and more particularly to a speaker adjustment method for a plurality of speakers and an electronic device using the same.

Description of Related Art

In today's dual-channel mobile device, although the sound outlet of the speaker is arranged at two symmetrical ends, since a tolerance of ±3 dB between individual speakers is allowed in the mass production, and there are differences in the design of mechanism in the mobile device, inconsistency often occurs in the frequency response of the left and right channel signals of the mobile device, which causes the sound field to deviate from the center of the mobile device. For example, when the frequency response of the left channel is greater than the frequency response of the right channel, the sound field is deviated to the left; otherwise, when the frequency response of the right channel is greater than the left channel, the sound field is deviated to the right.

SUMMARY OF THE DISCLOSURE

In view of the above, an embodiment of the present disclosure provides a speaker adjustment method and an electronic device using the same, which can well adjust the outputs of a plurality of speakers by using one microphone, so that the plurality of speakers can reach a target sound field during broadcasting.

The speaker adjustment method of the embodiment of the present disclosure is for adjusting a plurality of speakers. The speaker adjustment method includes the steps of: respectively obtaining a plurality of frequency responses of the plurality of speakers by using one microphone; obtaining distance information between the microphone and the plurality of speakers; and adjusting the outputs of the plurality of speakers according to the plurality of frequency responses and the distance information.

The electronic device of the embodiment of the disclosure includes a plurality of speakers, a microphone, and a processor. The plurality of speakers are configured to respectively broadcast a frequency scanning signal. The microphone is configured to respectively receive a plurality of audio signals when the plurality of speakers broadcast the frequency scanning signal. The processor is coupled to the plurality of speakers and the microphone, and configured to: obtain a plurality of frequency responses of the plurality of speakers according to the plurality of audio signals; obtain distance information between the microphone and the plurality of speakers; and adjust the outputs of the plurality of speakers according to the plurality of frequency responses and the distance information.

Based on the above, the speaker adjustment method and the electronic device using the same according to the embodiments of the present disclosure use the same microphone to obtain a plurality of frequency responses of a plurality of speakers, and then adjust the outputs of the plurality of speakers according to the frequency responses. In particular, when adjusting the outputs of the plurality of speakers according to the frequency responses, the distance information between the microphone and the plurality of speakers is also taken into consideration, such that the speaker adjustment method does not need to take into account the individual differences between the microphones in mass production. Meanwhile, it is also possible to eliminate the volume influence caused by different distances between the microphone and the plurality of speakers, thereby achieving good sound field adjustment.

In order to make the aforementioned features and advantages of the disclosure more comprehensible, embodiments accompanying figures are described in detail below.

DESCRIPTION OF EMBODIMENTS

The speaker adjustment method of the embodiment of the present disclosure adjusts a plurality of speakers by using a microphone. Since the distances between the microphone and the plurality of speakers might be different, and the different distances might cause the volume outputted by the speakers received by the microphone to have different attenuation, the speaker adjustment method in the embodiment of the present disclosure takes into account the distance between the microphone and the speakers to adjust the outputs of the speakers. Specifically, when using a single microphone to adjust the plurality of speakers, there is no need to take the individual differences between multiple microphones into consideration, and good adjustment result can be obtained by only taking into account the distances between the microphone and the plurality of speakers.

In the following descriptions, the speaker adjustment method will be described with an electronic device provided with a plurality of speakers and a single microphone. However, it should be noted that the present disclosure is not limited thereto, and the proposed speaker adjustment method can also be applied to other audio systems or electronic systems such as a movie theater, a home theater and so on.

Figure 1A:
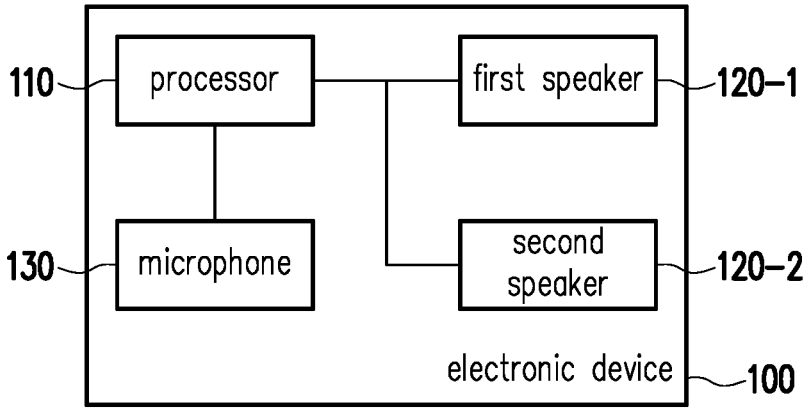
FIG. 1A is a schematic block view of an electronic device according to an embodiment of the disclosure.

FIG. 1A is a schematic block view of an electronic device according to an embodiment of the disclosure.

Referring to FIG. 1A, in the embodiment, an electronic device 100 includes, for example, a processor 110, a first speaker 120_1, a second speaker 120_2, and a microphone 130, wherein the first speaker 120_1, the second speaker 120_2, and the microphone 130 are coupled to the processor 110. It should be noted that two speakers are exemplified in the present embodiment, but the present disclosure provides no limitation to the number of the speaker.

The processor 110 is, for example, a dual core, quad core, or eight core central processing unit (CPU), a system-on-chip (SOC), an application processor, a media processor, a microprocessor, a digital signal processor, a programmable controller, an application specific integrated circuit (ASIC), a programmable logic device (PLD) or other similar device or a combination of these devices, the present disclosure is not limited thereto. In addition, for convenience of description, the positions of the first speaker 120_1 and the second speaker 120_2 in the following description refer to the sound outlet positions of the left channel and the right channel of the electronic device 100, respectively, and the position of the microphone 130 refers to the position of the sound outlet of the electronic device 100.

Figure 1B:
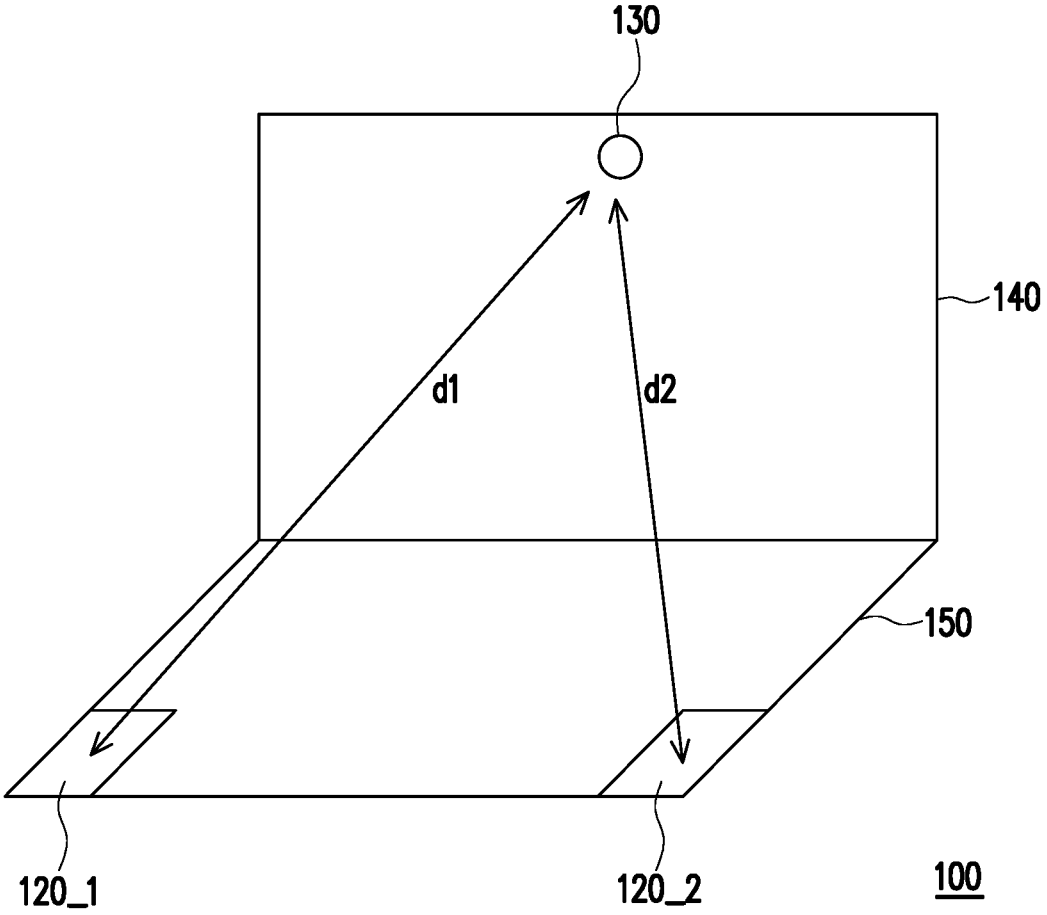
FIG. 1B is a schematic view of an electronic device according to an embodiment of the disclosure.

FIG. 1B is a schematic view of an electronic device according to an embodiment of the disclosure.

Referring to FIG. 1B, in the embodiment, the electronic device 100 is, for example, a lifting cover electronic device, and includes an upper cover 140 and a lower base 150 that can be opened/closed with respect to each other. For example, the upper cover 140 can be configured to set a display panel (not shown) of the electronic device 100, and the lower base 150 can be configured to set the processor 110, the memory (not shown) and so on of the electronic device 100, the disclosure is not limited thereto. In the embodiment, the first speaker 120_1 and the second speaker 120_2 are symmetrically fixed to the lower base 150 of the electronic device 100. In addition, the microphone 130 is fixedly disposed on the upper cover 140 of the electronic device 100.

In this embodiment, the first speaker 120_1 and the second speaker 120_2 are symmetrically disposed, and the processor 110 is responsible for performing a speaker adjustment method to adjust the first speaker 120_1 and/or the second speaker 120_2 so that the sound field of the electronic device 100 is maintained in the middle.

It should be noted that in the present embodiment, the distance d1 between the microphone 130 and the first speaker 120_1 is different from the distance d2 between the microphone 130 and the second speaker 120_2 (for example, the microphone 130 is not located on the center line of the upper cover 140). However, the present disclosure is not limited thereto, and in some embodiments, the distance d1 between the microphone 130 and the first speaker 120_1 and the distance d2 between the microphone 130 and the second speaker 120_2 may also be the same (for example, the microphone 130 is located on the center line of the upper cover 140).

Figure 2:
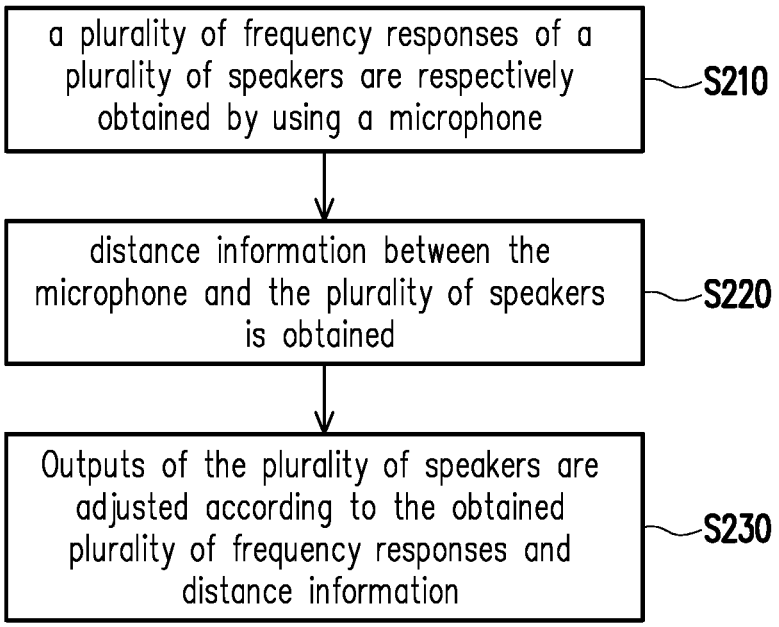
FIG. 2 is a flow chart of a speaker adjustment method according to an embodiment of the present disclosure.

FIG. 2 is a flow chart of a speaker adjustment method according to an embodiment of the present disclosure.

The speaker adjustment method of the present embodiment is adapted to the electronic device 100 in FIG. 1A and FIG. 1B, and therefore will be described below with reference to the electronic device 100. However, it should be understood that the speaker adjustment method of this embodiment can also be adapted to other audio systems or electronic systems, and is not limited to the electronic device 100.

Referring to FIG. 2, in step S210, a plurality of frequency responses of a plurality of speakers are respectively obtained by using a microphone. Specifically, each speaker will separately broadcast a frequency scanning signal, and the microphone respectively receive the audio signals when each of the speakers broadcasts the frequency scanning signal to obtain the frequency response of each speaker. The frequency scanning signal is, for example, a signal of which the amplitude does not change but the frequency changes, and those having ordinary skill in the art can understand the meaning of the frequency scanning signal, so related descriptions are not incorporated herein.

In this embodiment, the processor 110 first broadcasts the frequency scanning signal through the first speaker 120_1. The microphone 130 receives the audio signal when the first speaker 120_1 broadcasts the frequency scanning signal, so the processor 110 can obtain the first frequency response of the first speaker 120_1. Then, the processor 110 broadcasts the same frequency scanning signal through the second speaker 120_2. The microphone 130 receives the audio signal when the second speaker 120_2 broadcasts the frequency scanning signal, so the processor 110 can obtain the second frequency response of the second speaker 120_2.

It should be mentioned that when the first speaker 120_1 and the second speaker 120_2 broadcast signals with the same amplitude, the volume influence ratio of the audio signals received by the microphone 130 from the first speaker 120_1 and the second speaker 120_2 is proportional to log (d1/d2). That is, the first frequency response and the second frequency response are associated with the distance d1 and the distance d2, so if the speaker is adjusted directly according to the first frequency response and the second frequency response, such adjustment will result in different adjustment results due to the difference in the positions of the microphone 130.

In step S220, distance information between the microphone and the plurality of speakers is obtained. In order to compensate for the volume influence that might be caused by the distance between the microphone and the plurality of speakers, it is required to obtain information about the distance between the microphone and the plurality of speakers, such as the distance ratio between the microphone and each speaker, or the absolute distance between the microphone and each speaker, etc., the disclosure is not limited thereto.

In this embodiment, the processor 110 can obtain the distance d1 and the distance d2, or obtain the distance ratio d1/d2 between the distance d1 and the distance d2 according to the design of the electronic device 100, that is, the positions where the first speaker 120_1, the second speaker 120_2, and the microphone 130 are disposed on the electronic device 100.

In some embodiments, when the electronic device 100 is a lifting cover electronic device, the closing angle (i.e., the angle between the upper cover 140 and the lower base 150) directly affects the distance information about the microphone 130, the first speaker 120_1, and the second speakers 120_2. On this occasion, the processor 110 may first obtain the closing angle, and then calculate the distance information about the microphone 130, the first speaker 120_1 and the second speaker 120_2 according to the closing angle.

However, the present disclosure provides no limitation to the specific way of obtaining distance information. In other embodiments, the electronic device 100 may also be provided with a distance sensor (not shown) for measuring the distance d1 between the microphone 130 and the first speaker 120_1 and the distance d2 between the microphone 130 and the second speaker 120_2. The processor 110 can directly obtain the distance information through the distance sensor.

In step S230, the plurality of speakers are adjusted according to the obtained plurality of frequency responses and distance information. As described in the previous paragraph, the plurality of frequency responses obtained in step S210 are associated with the distance between the microphone and the plurality of speakers, and thus the distance information between the microphone and the plurality of speakers obtained in step S220 should also be taken into consideration when the plurality of speakers are adjusted according to the frequency responses.

In this embodiment, the distance information obtained by the processor 110 in step S220 is, for example, a distance ratio d1/d2. According to the information, the processor 110 can calibrate the first frequency response and the second frequency response into a first equidistant frequency response and a second equidistant frequency response according to the volume influence ratio log (d1/d2) of the audio signal received by the microphone 130 from the first speaker 120_1 and the second speaker 120_2. The first equidistant frequency response and the second equidistant frequency response respectively represent the frequency responses of the first speaker 120_1 and the second speaker 120_2 respectively after the volume influence caused by the difference in the distances between the microphone 130 and the first speaker 120_1 and the second speaker 120_2 is eliminated. For example, if the distance d1 is greater than the distance d2, the processor 110 may, for example, increase the magnitude (decibel) of the first frequency response and/or reduce the magnitude (decibel) of the second frequency response according to the volume influence ratio log (d1/d2), thereby eliminating the volume influence caused by the difference in the distances between the microphone 130 and the first speaker 120_1 and the second speaker 120_2.

Figure 3:
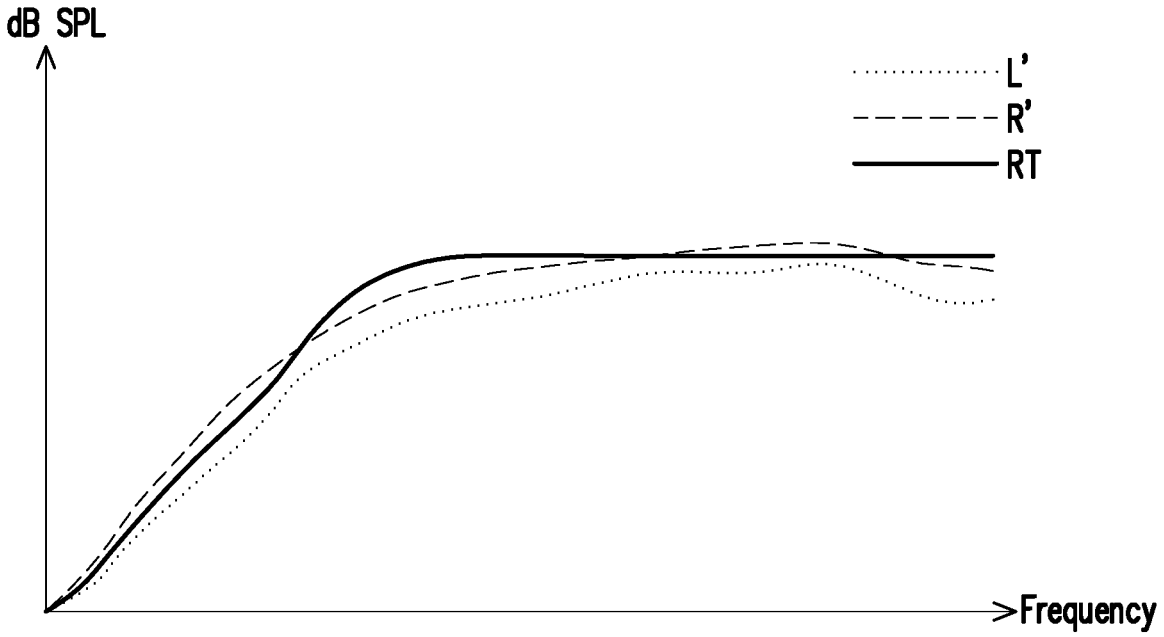
FIG. 3 is a schematic view of a frequency response according to an embodiment of the disclosure.

FIG. 3 is a schematic view of a frequency response according to an embodiment of the disclosure.

Please refer to FIG. 3. FIG. 3 illustrates a first equidistant frequency response L', a second equidistant frequency response R', and a target frequency response RT. In this embodiment, after eliminating the volume influence caused by the difference in distances between the microphone 130 and the first speaker 120_1 and the second speaker 120_2, the first equidistant frequency response L' and the second equidistant frequency response R' are still different, and such phenomenon might be caused by a difference in the mechanical design between the first speaker 120_1 and the second speaker 120_2 or the element layout of the electronic device 100 and so on. Therefore, the processor 110 can adjust the outputs of the plurality of speakers according to the first equidistant frequency response L' and the second equidistant frequency response R' thereby adjusting the sound field symmetry of the electronic device 100.

In this embodiment, in order to balance the sound field of the electronic device 100, the processor 110 determines, for example, a target frequency response RT to adjust the outputs of the first speaker 120_1 and the second speaker 120_2 according to the determined target frequency response RT, thereby adjusting the first equidistant frequency response L' and the second equidistant frequency response R' toward the target frequency response RT.

The target frequency response RT may be relevant or irrelevant to the plurality of frequency responses obtained in step S210. In some embodiments, the target frequency response RT can be predefined by the user. In some embodiments, the target frequency response RT may be determined by the processor 110 according to the first equidistant frequency response L' and the second equidistant frequency response R'. For example, the processor 110 may select one of the first equidistant frequency response L' and the second equidistant frequency response R' as the target frequency response RT. In another example, the processor 110 may calculate the target frequency response RT by means of the average and/or moving average according to the first equidistant frequency response L' and the second equidistant frequency response R'. In other words, the present disclosure provides no limitation to the specific determining method of the target frequency response RT, and those having ordinary skill in the art can implement the determining method depending on the needs.

In this embodiment, when adjusting the outputs of the plurality of speakers, the processor 110 adjusts, for example, an equalizer (EQ) corresponding to the first speaker 120_1 and the second speaker 120_2 to adjust the first equidistant frequency response L' and the second equidistant frequency response R' toward the target frequency response RT. In this way, the electronic device 100 can have a symmetric and balanced sound field when broadcasting audio through the first speaker 120_1 and the second speaker 120_2.

It should be mentioned that the present disclosure provides no limitation to the specific adjustment items when adjusting the outputs of the plurality of speakers. In addition to the equalizer corresponding to each speaker, the outputs of the speakers can also be adjusted by means of Fast Fourier Transform (FFT) or wavelet transform.

In summary, the speaker adjustment method and the electronic device using the same described in the embodiments of the present disclosure use the same microphone to obtain a plurality of frequency responses of a plurality of speakers, and then adjust the outputs of the plurality of speakers according to the frequency responses. Specifically, when adjusting the outputs of the plurality of speakers according to the frequency responses, the distance information between the microphone and the plurality of speakers is taken into consideration, such that the speaker adjustment method does not need to take into account the individual differences between the microphones in mass production. Meanwhile, it is also possible to eliminate the volume influence caused by different distances between the microphone and the plurality of speakers, thereby achieving good sound field adjustment.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A speaker adjustment method for adjusting a plurality of speakers, the speaker adjustment method comprising:

obtaining a plurality of frequency responses of the plurality of speakers respectively by using a microphone;

obtaining a distance information between the microphone and the plurality of speakers; and adjusting outputs of the plurality of speakers according to the plurality of frequency responses and the distance information, wherein the plurality of speaker and the microphone are disposed in a lifting cover electronic device, wherein the step of obtaining the distance information between the microphone and the plurality of speakers comprises:

obtaining a closing angle of the lifting cover electronic device; and calculating the distance information according to the closing angle.

2. The speaker adjustment method according to claim 1, wherein the step of obtaining the plurality of frequency responses of the plurality of speakers respectively by using the microphone comprises:

respectively broadcasting a frequency scanning signal by the plurality of speakers, so as to generate a plurality of audio signals; and receiving the plurality of audio signals from the plurality of speakers by the microphone, so as to obtaining the plurality of frequency responses of the plurality of speakers.

3. The speaker adjustment method according to claim 1, wherein the plurality of speaker comprise a first speaker and a second speaker, wherein the step of obtaining the distance information between the microphone and the plurality of speakers comprises:

calculating a distance ratio of a first distance between the microphone and the first speaker to a second distance between the microphone and the second speaker.

4. The speaker adjustment method according to claim 1, wherein the step of adjusting the outputs of the plurality of speakers according to the plurality of frequency responses and the distance information comprises:

calibrating the plurality of frequency responses according to the distance information to obtain a plurality of equidistant frequency responses corresponding to the plurality of speakers; and adjusting the outputs of the plurality of speakers to adjust the equidistant frequency responses corresponding to the plurality of speakers toward a target frequency response.

5. The speaker adjustment method according to claim 4, wherein the step of calibrating the plurality of frequency responses according to the distance information to obtain the plurality of equidistant frequency responses corresponding to the plurality of speakers comprises:

obtaining a volume influence ratio according to the distance information; and calibrating the plurality of frequency responses according to the volume influence to obtain the plurality of equidistant frequency responses corresponding to the plurality of speakers.

6. The speaker adjustment method according to claim 1, wherein the step of adjusting the outputs of the plurality of speakers according to the plurality of frequency responses and the distance information comprises:

determining a target frequency response according to the plurality of frequency responses; and adjusting the outputs of the plurality of speakers according to the target frequency response, the plurality of frequency responses, and the distance information.

7. The speaker adjustment method according to claim 6, wherein the step of determining the target frequency response according to the plurality of frequency responses comprises:

calculating average or moving average of the plurality of frequency responses to obtain the target frequency response.

8. The speaker adjustment method according to claim 1, wherein the step of adjusting the outputs of the plurality of speakers according to the plurality of frequency responses and the distance information comprises:

adjusting an equalizer corresponding to each of the plurality of speakers.

9. The speaker adjustment method according to claim 1, wherein the step of adjusting the outputs of the plurality of speakers according to the plurality of frequency responses and the distance information comprises:

adjusting the outputs of the plurality of speakers by using Fast Fourier Transform (FFT) or wavelet transform.

10. An electronic device, comprising:

a plurality of speakers, configured to respectively broadcast a frequency scanning signal;

a microphone, configured to respectively receive a plurality of audio signals when the plurality of speakers broadcast the frequency scanning signal; and a processor, coupled to the plurality of speakers and the microphone, configured to:

obtain a plurality of frequency responses of the plurality of speakers according to the plurality of audio signals;

obtain a distance information between the microphone and the plurality of speakers; and adjust outputs of the plurality of speakers according to the plurality of frequency responses and the distance information, wherein the electronic device is a lifting cover electronic device, wherein when the distance information between the microphone and the plurality of speakers is obtained, the processor is configured to:

obtain a closing angle of the lifting cover electronic device; and calculate the distance information according to the closing angle.

11. The electronic device according to claim 10, further comprising:

a distance sensor, coupled to the processor, configured to measure the distance between the microphone and the plurality of speakers to obtain the distance information.

12. The electronic device according to claim 10, wherein the plurality of speakers comprise a first speaker and a second speaker, wherein when the distance information between the microphone and the plurality of speakers is obtained, the processor is configured to:

calculate a distance ratio of a first distance between the microphone and the first speaker to a second distance between the microphone and the second speaker.

13. The electronic device according to claim 10, wherein when the outputs of the plurality of speakers are adjusted according to the plurality of frequency responses and the distance information, the processor is configured to:

calibrate the plurality of frequency responses according to the distance information to obtain a plurality of equidistant frequency responses corresponding to the plurality of speakers; and adjust the outputs of the plurality of speakers to adjust the plurality of equidistant frequency responses corresponding to the plurality of speakers toward a target frequency response.

14. The electronic device according to claim 13, wherein when the plurality of frequency responses are calibrated according to the distance information to obtain the plurality of equidistant frequency responses corresponding to the plurality of speakers, the processor is configured to:

obtain a volume influence ratio according to the distance information; and calibrate the plurality of frequency responses according to the volume influence to obtain the plurality of equidistant frequency responses corresponding to the plurality of speakers.

15. The electronic device according to claim 10, wherein when the outputs of the plurality of speakers are adjusted according to the plurality of frequency responses and the distance information, the processor is configured to:

determine a target frequency response according to the plurality of frequency responses; and adjust the outputs of the plurality of speakers according to the target frequency response, the plurality of frequency responses, and the distance information.

16. The electronic device according to claim 15, wherein when the target frequency response is determined according to the plurality of frequency responses, the processor is configured to:

calculate average or moving average of the plurality of frequency responses to obtain the target frequency response.

17. The electronic device according to claim 10, wherein when the outputs of the plurality of speakers are adjusted according to the plurality of frequency responses and the distance information, the processor is configured to:

adjust an equalizer corresponding to each of the plurality of speakers.

18. The electronic device according to claim 10, wherein when the outputs of the plurality of speakers are adjusted according to the plurality of frequency responses and the distance information, the processor is configured to:

adjust the outputs of the plurality of speakers by using Fast Fourier Transform (FFT) or wavelet transform.

* * * * *